US006158687A

United States Patent [19]

Widmer

[11] Patent Number: 6,158,687

[45] Date of Patent: Dec. 12, 2000

[54] WINDING APPARATUS FOR PAPER WEBS AND METHOD OF WINDING PAPER WEBS

[75] Inventor: Josef Widmer, Reiden, Switzerland

[73] Assignee: Hunkeler AG, Wikon, Switzerland

[21] Appl. No.: 09/194,868

[22] PCT Filed: May 8, 1998

[86] PCT No.: PCT/CH98/00188

§ 371 Date: Jan. 4, 1999

§ 102(e) Date: Jan. 4, 1999

[87] PCT Pub. No.: WO98/51601

PCT Pub. Date: Nov. 19, 1998

[30] Foreign Application Priority Data

May 9, 1997 [CH] Switzerland ..... 1090/97

[51] Int. Cl.[7] ..... B65H 23/198; B65H 23/10

[52] U.S. Cl. ..... 242/413.6; 242/413.9; 242/419.9

[58] Field of Search ..... 242/412.2, 412.3, 242/413.1, 413.5, 413.6, 413.9, 417, 418, 418.1, 419.1, 419.5, 419.9

[56] References Cited

U.S. PATENT DOCUMENTS

| | | | |
|---|---|---|---|
| 3,372,320 | 3/1968 | Boyum et al. . | |
| 3,982,710 | 9/1976 | Teumer . | |
| 4,177,410 | 12/1979 | Dowd . | |
| 4,245,897 | 1/1981 | Beauviala et al. | 242/418.1 |
| 4,351,460 | 9/1982 | Ouellette | 242/419.9 |
| 4,650,133 | 3/1987 | White et al. | 242/419.9 |
| 4,660,783 | 4/1987 | Roser et al. | 242/419.9 |
| 4,951,895 | 8/1990 | Hirai | 242/419.9 |
| 5,060,881 | 10/1991 | Bogucki-Land | 242/418 |
| 5,080,295 | 1/1992 | Hongo et al. | 242/419.9 |
| 5,422,454 | 6/1995 | Kajitori | 242/419.9 |
| 5,758,840 | 6/1998 | Murakami | 242/418 |

FOREIGN PATENT DOCUMENTS

| | | |
|---|---|---|
| 14 36 891 | 5/1970 | Germany . |
| 20 30 242 | 12/1971 | Germany . |
| 26 17 137 A1 | 10/1977 | Germany . |
| 39 19 162 A1 | 12/1989 | Germany . |

*Primary Examiner*—John M. Jillions
*Attorney, Agent, or Firm*—Oliff & Berridge, PLC

[57] ABSTRACT

The winding apparatus (1) for a paper, textile, plastic or other material web (2) comprises a reel drive apparatus (5) for driving a reel (3), in order to convey the web (2) in a feed direction (Z) and to wind it onto the reel (3), and a web tension roll (12), which is arranged upstream of the reel (3) in the feed direction (Z), in order to produce a tension which acts on the web (2) counter to the feed direction (Z), the web tension roll (12) being coupled to a drive apparatus (15), the drive apparatus (15) comprising a clutch (20) and a drive (17), the clutch (20) being operatively arranged between the drive (17) and the web tension roll (12), and the clutch (20) permitting slip between the drive (17) and the web tension roll (12).

12 Claims, 4 Drawing Sheets

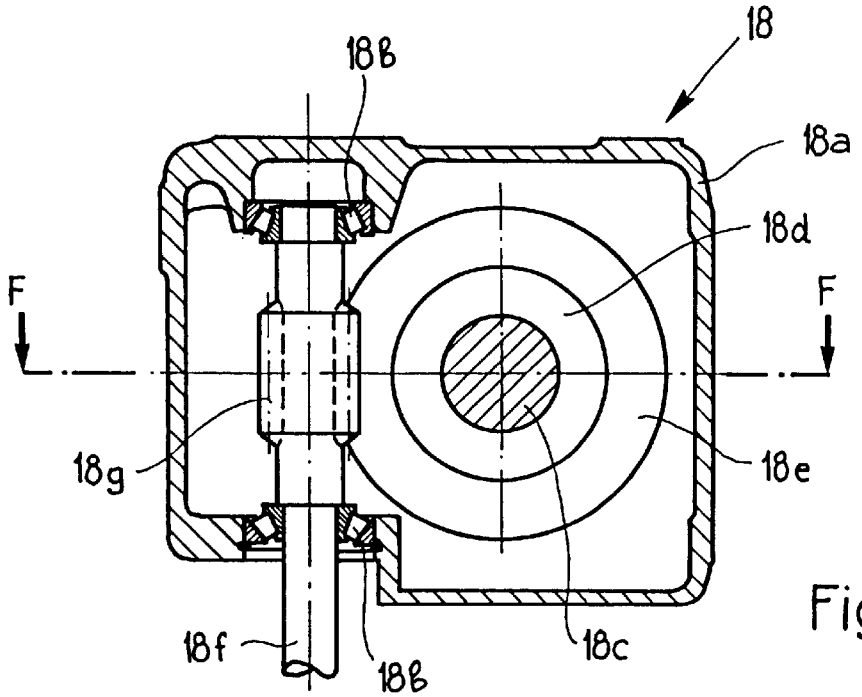
Fig. 5a (E-E)
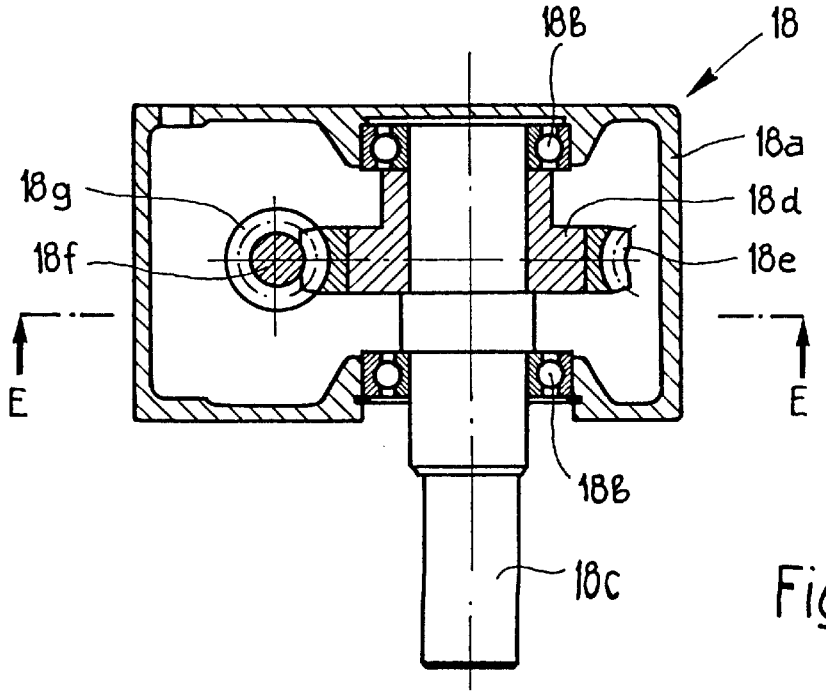
Fig. 5b (F-F)

WINDING APPARATUS FOR PAPER WEBS AND METHOD OF WINDING PAPER WEBS

The invention relates to a winding apparatus for paper, textile, plastic or other material webs and to a method of winding such webs.

It is known to wind paper, textile, plastic or other material webs onto a reel, and then to feed them, by unwinding the reel, to a further processing process, such as a printing, cutting or packing apparatus.

A central function during the winding of a reel is the production of a tensile force on the web. The winding quality and, associated with this, the unwinding characteristics of the reel are strongly influenced by the web tension that is present during the winding operation.

The object of the present invention is to propose a winding apparatus for paper, textile, plastic or other material webs which has more advantageous winding characteristics, and/or allows a tension acting on the web to be produced more advantageously.

The object is in particular achieved with a winding apparatus, for a paper, textile, plastic or other material web, which comprises a reel drive apparatus for driving a reel, in order to convey the web in a feed direction and to wind it onto the reel, and a web tension roll, which is arranged upstream of the reel in the feed direction, in order to produce a tension which acts on the web counter to the feed direction, the web tension roll being coupled to a drive apparatus, the drive apparatus comprising a self-locking mechanism and a drive, and the self-locking mechanism being operatively arranged between the drive and the web tension roll.

The operative arrangement of the self-locking mechanism between the web tension roll and the drive has the advantage that, by means of an appropriately controlled speed of the drive of the web tension roll, braking energy can be extracted via the self-locking mechanism, it being possible for the extracted braking energy to be dissipated via the housing of the self-locking mechanism.

In an advantageous embodiment, the drive apparatus has a clutch that is operatively arranged between the web tension roll and the drive.

The object is in particular further achieved with a winding apparatus, for a paper, textile, plastic or other material web, which comprises a reel drive apparatus for driving a reel, in order to convey the web in a feed direction and to wind it onto the reel, and a web tension roll, which is arranged upstream of the reel in the feed direction, in order to produce a tension which acts on the web counter to the feed direction, the web tension roll being coupled to a drive apparatus and the drive apparatus comprising a clutch and a drive, so that the clutch is operatively arranged between the drive and the web tension roll, and the clutch permits slip between the drive and the web tension roll.

Neither friction nor slip must occur between the web tension roll and the conveyed web, in order not to damage the web, which consists of paper, for example, or the imprint on the web.

One advantage of the inventive winding apparatus is to be seen in the fact that a tensile force can be produced on the paper web even when the latter is at a standstill. The drive apparatus applies a torque to the web tension roll which acts counter to the conveying direction, the clutch that is arranged between the drive and the web tension roll being operated with slip and, at the same time, the speed of the drive and/or the slip of the clutch being controlled in such a way that the web tension roll remains stationary.

In a preferred embodiment, the drive acting on the web tension roll is configured as a controllable, variable-speed motor. In a further preferred embodiment, the clutch has means which can be controlled, for example magnetically or pneumatically, in order to control the maximum transmissible torque, so that the slip can be controlled with the aid of a control device.

In a particularly advantageous embodiment, the self-locking mechanism is arranged between the drive and the clutch. One advantage of this embodiment is to be seen in the fact that the self-locking mechanism is used, inter alia, to dissipate the braking energy that is extracted from the web tension roll, via the self-locking mechanism, to a stationary housing. In this case, the speed of the drive is advantageously controlled in such a way that the clutch has a relatively low slip of, for example, 5% to 10%, so that in the clutch, on the one hand, a relatively small amount of frictional heat is produced, and therefore the clutch, on the other hand, can also be dimensioned to be relatively small. Since the self-locking mechanism conducts a large part of the braking energy to the housing, a drive motor having a small power is sufficient. In an advantageous refinement, the drive motor is configured as a small, asynchronous motor whose speed may be controlled with a power controller. A power controller is also referred to as a frequency converter.

The speed of the drive motor is, for example, controlled in such a way that the clutch always has a slip of 5%, the drive motor acting in the same direction as the movement of the web at relatively high web speeds, and the drive motor being driven in the opposite direction at very low web speeds, in particular when the web is at a standstill, so that a tensile force is applied to the web via the web tension roll even when the web is at a standstill.

In an advantageous refinement, the self-locking mechanism is configured as a worm-drive mechanism.

The reel onto which the paper web is wound can be driven at the center or at its periphery.

The invention will be explained in detail with reference to several exemplary embodiments. In the drawings:

FIG. 1 shows a schematic illustration of a winding apparatus;

FIG. 1*a* shows a detail view of a clutch;

FIGS. 5*a,* 5*b* show a sectional view of a self-locking mechanism.

Figure 1:
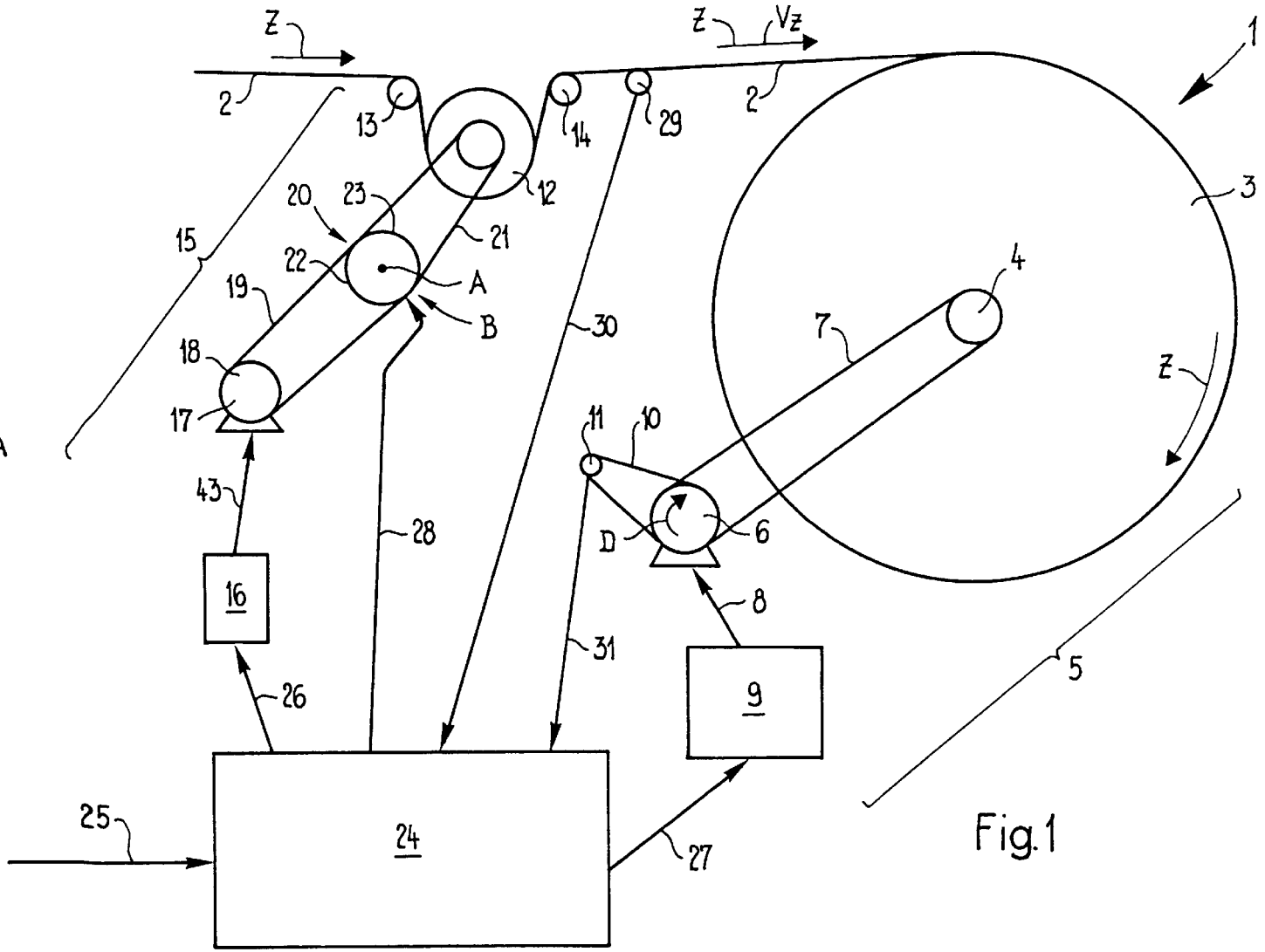

The winding apparatus 1 which is illustrated schematically according to FIG. 1 is used to wind a paper web 2 onto a reel 3. The reel 3, which is mounted on a winder shaft 4, is driven by a reel drive apparatus 5, so that the web 2 is moved in a feed direction Z. The reel drive apparatus 5 comprises a motor 6, which on one side is connected via a toothed belt 7 to the winder shaft 4, in order to drive the latter, and on the other side is connected via an electric line 8 to a frequency converter 9. The motor 6 is configured as an AC motor, and the frequency converter 9 comprises power electronics which are suitable to generate a rotating field in order to drive the AC motor 6. The motor 6 is connected via a further toothed belt 10 to a sensor 11 for measuring the motor speed D. The sensor 11 could also be arranged at a different point, for example inside the motor 6 or at the winder shaft 4, in order to measure the rotational speed. A web tension roll 12 is placed upstream of the reel 3, in the feed direction Z, the two turn rolls 13, 14 being arranged in such a way in relation to the web tension roll 12 that the web 2 is in contact with the web tension roll 12 over a portion of the circumference of the latter. The web tension roll 12 is used for the purpose of producing, on that section of the web 2 which follows the web tension roll 12, a web tension which acts counter to the feed direction Z. The web tension roll 12 is designed and is operated in such a way that that portion of the web 2 which rests on the web tension roll 12 follows the movement of the web tension roll 12 without slip. This prevents any friction or any mutual relative movement between the web tension roll 12 and the paper web 2, which could otherwise damage the paper web 2 or an imprint on the paper. In the exemplary embodiment illustrated, the web tension roll 12 has a rubber-covered surface. The maximum producible web tension depends, inter alia, on the wrap angle of the web 2 around the web tension roll 12, so that with a large wrap angle, a correspondingly large, maximum web tension can be produced, the condition always having to be satisfied that no slip or no sliding occurs between the web tension roll 12 and the paper web 2. The rotational speed of the web tension roll 12 is thus determined by the web speed vz of the web 2. A drive apparatus 15 which acts on the web tension roll 12 is used to impart a torque, which acts counter to the feed direction Z, to the web tension roll 12, the maximum torque being determined by the requirement that no slip must occur between the paper web 2 and the web tension roll 12. The drive apparatus 15 comprises a variable-speed motor 17, which can be controlled via a frequency converter 16, and which in turn is configured as an AC motor. The shaft of the motor 17 is connected to a clutch 20 via a self-locking mechanism, that is, self-locking gear mechanism, 18 and a toothed belt 19. The clutch 20 has two concentrically arranged pulleys 22, 23, and permits the slip between the pulleys 22, 23 to be influenced. The clutch 20 is connected to the web tension roll 12 via the pulley 23 and a toothed belt 21. The clutch 20 comprises a controllable friction clutch, which, for example, is configured such that it can be controlled magnetically or pneumatically, in order to produce a controllable slip between the web tension roll 12 and the motor 17. A control device 24 is provided in order to control the winding apparatus 1, and is connected via a data bus 25 to further control devices or a higher-order computer. The frequency converters 9, 16 are controlled via electric signal lines 26, 27. The motor 17 is connected to the frequency converter 16 via a connecting line 43. The braking force of the controllable friction clutch 20 is controlled via an electric signal line 28. The speed vz of the web 2 is sensed by a sensor 29, and fed to the control device 24 via an electric signal line 30. The rotational speed D, registered by the sensor 11, of the motor 6 or of the winder shaft 4 is fed to the control device 24 via a signal line 31. Since the motor 6 is rigidly coupled to the winder shaft 4 via the toothed belt 7 or a further mechanism, it is possible for both the rotational speed of the motor 6 and the rotational speed of the winder shaft 4 to be calculated from the signal of the sensor 11.

During the operation of the apparatus according to FIG. 1, the motor 6 drives the reel 3 in the feed direction Z, so that the web 2 is conveyed in the feed direction Z at a web speed vz. The tensile force acting on the web 2 is produced by the web tension roll 12. The braking force, and hence the web tension, can be set by means of parameters on the control and regulating device 24. The clutch 20 is controlled directly by the control device 24, using pulse width modulation, in such a way that the set braking force is produced. In order to reduce the friction losses and the wear on the clutch 20, the latter is made to follow at reduced speed by the motor 17, via a self-locking mechanism 18. In order to maintain or to build up the web tension, even when the web 2 is at a standstill, the motor 17 and the pulley 22 of the clutch 20 are rotated slowly backwards.

When the web 2 is at a standstill, the drive apparatus 15 is operated in such a way that the clutch 20 applies a torque to the web tension roll 12, the web tension roll 12 remaining at a standstill. The motor 17 transmits a torque to the clutch 20, the speed of the motor 17 and/or the clutch 20 being controlled, via the electric lines 26, 28, in such a way that the clutch 20 has a slip such that the web tension roll 12 remains at a standstill. With increasing web speed vz, the speed of the motor 17 or the braking force of the clutch 20 is, for example, continuously made to follow in such a way that the clutch 20 has a slip of about 5%, irrespective of its rotational speed. The braking energy extracted from the web tension roll 12 is fed via the clutch 20 to the self-locking mechanism 18, which is illustrated only schematically, which produces a countertorque and conducts the energy to a housing (not illustrated). By using a self-locking mechanism 18 of this type, it is necessary for the motor 17 to produce only a relatively small torque, and it can therefore be operated at low power. The slip of the clutch 20 is kept to a relatively small value of, for example, 2% to 10%, for which reason the frictional heat generated in the clutch 20 is low, so that a small and correspondingly cost-effective clutch 20 can be used. This ensures low-energy braking of the web 2.

The web speed vz, which is measured by the sensor 29, a measuring wheel, and the rotational speed of the reel 3, which can be calculated via the sensor 11, can be used by the control device 24 to calculate the diameter of the reel. The motor 17 is controlled via a frequency converter 16 in such a way that, at a small diameter of the reel 3, a high tension is produced in the web 2, and at a large diameter of the reel 3, a smaller tension is produced in the web 2. In particular when starting the winding operation, the reel 3 has a very small diameter, so that a high web tension is necessary.

Figure 1A:
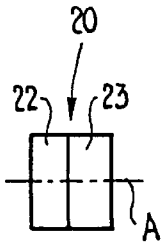

FIG. 1*a* shows the clutch 20 from the viewing direction B, the toothed belt 19, 21 running over the pulleys 22, 23 not being illustrated. The two pulleys 22, 23 are arranged mounted alongside each other so that they can rotate about the common axis A, the clutch 20 having additional means (not illustrated) in order to couple the two pulleys 22, 23 to each other in a controllable manner.

In a further exemplary embodiment, it would be possible to dispense with the clutch 20 in the winding apparatus 1 according to FIG. 1, by the web tension roll 12 being driven directly by the motor 17, via a toothed belt 19, using a self-locking mechanism 18. As compared with this solution, the use of a clutch 20 has the advantage that the clutch 20 permits speed fluctuations between the web tension roll 12 and mechanism 18 to be compensated in a simple way, since the clutch is simple to control and regulate.

Figure 2:
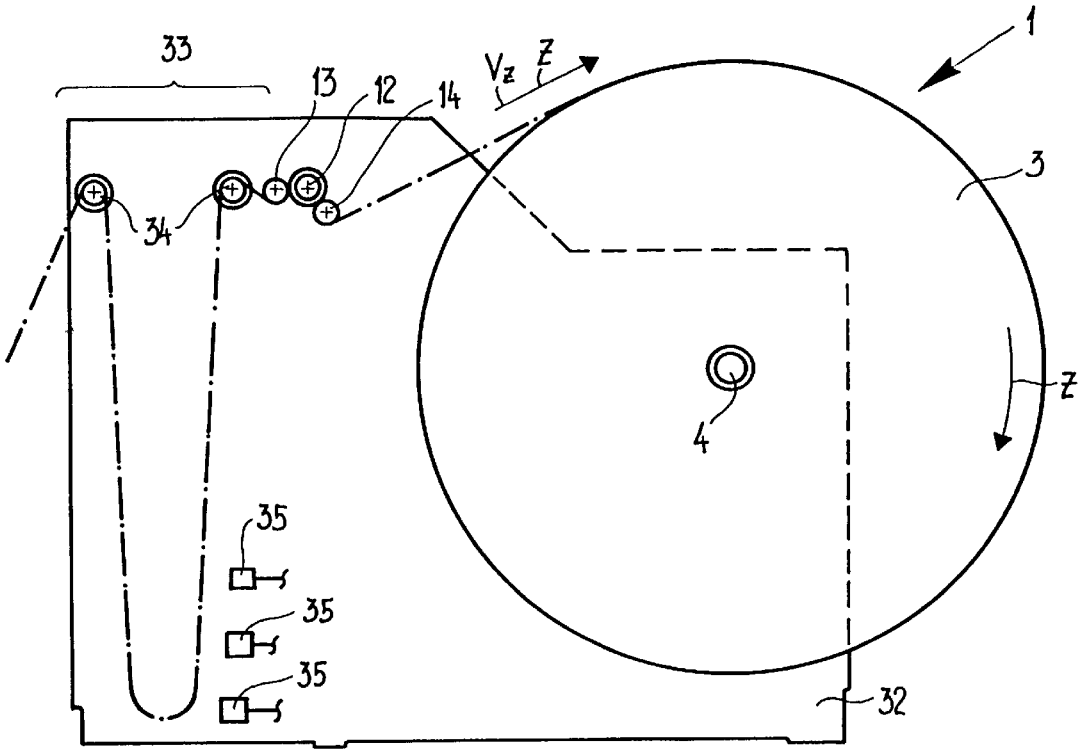
FIG. 2 shows a side view of a further winding apparatus.
Figure 3:
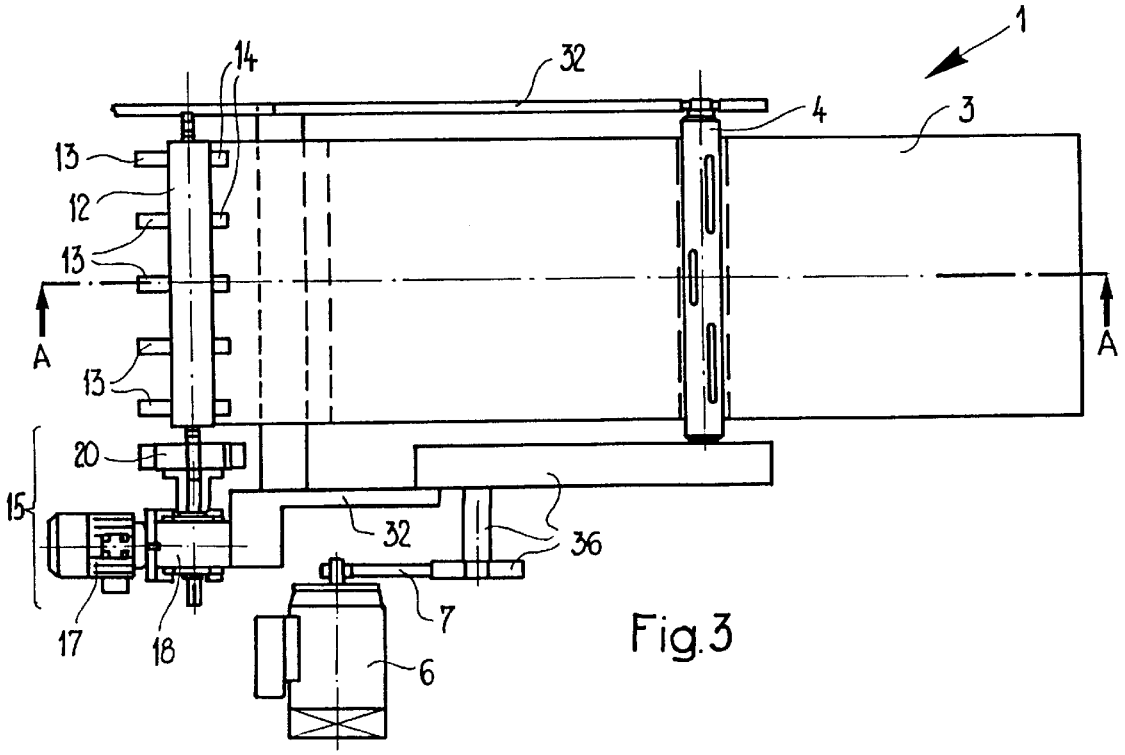
FIG. 3 shows a plan view of the winding apparatus according to FIG. 2.

The side view illustrated in FIG. 2 of a further winding apparatus 1, a cross section along the line A—A according to FIG. 3, illustrates a housing 32, in which the winder shaft 4, the web tension roll 12 and the turn rolls 13, 14 are arranged. In this exemplary embodiment, the turn rolls 13, 14 press the paper web 2 directly onto the rubber-covered surface of the web tension roll 12. The turn rolls 13, 14 could also be arranged in such a way that the turn roll 13 or 14 presses onto the web tension roll 12, whereas the other turn roll 14 or 13 is arranged at a distance from the surface of the web tension roll 12. Arranged upstream of the web tension roll 12 in the feed direction Z is a storage device 33, a so-called dancer. The storage device 33 has two turn rolls 34, between which a supply of the paper web 2 is stored. Using a number of optical sensors 35, the stored length of the paper web 2 is registered, and this measured variable is fed to the control device 24 via an electric signal line, for example the line 25.

From the plan view according to FIG. 3, it is possible to see the reel 1, mounted at its center, with the winder shaft 4. The winder shaft 4 is driven by the motor 6 via a toothed belt 7 and a further torque transmission device 36, which is configured as a multistage gear mechanism. The drive apparatus 15 which acts on the web tension roll 12 comprises a motor 17, whose shaft is connected to the self-locking mechanism 18, which is designed as a worm-gear mechanism. The output shaft of the self-locking mechanism 18 is connected to the clutch 20. The clutch 20 is connected to the web tension roll 12 via a further shaft. The mechanism 18 is firmly connected to the housing 32.

The exemplary embodiment according to FIGS. 2 and 3 is operated in such a way that the sensors 35 are used to register the length of the web 2 stored in the storage device 33, and this value is fed to the control and regulating device 24. Using a higher-order control loop, the rotational speed of the reel 3, or the winding speed, is controlled via the motor 6 in such a way that there is always approximately the same stored length in the storage device 33. Using a nested control loop, the motor 17 and/or the clutch 20 are controlled in such a way that the slip in the clutch 20 is, for example, always 5%, and, depending on the diameter of the reel 3, the tension previously set in the control device 24 is produced in the web 2.

Figure 4:
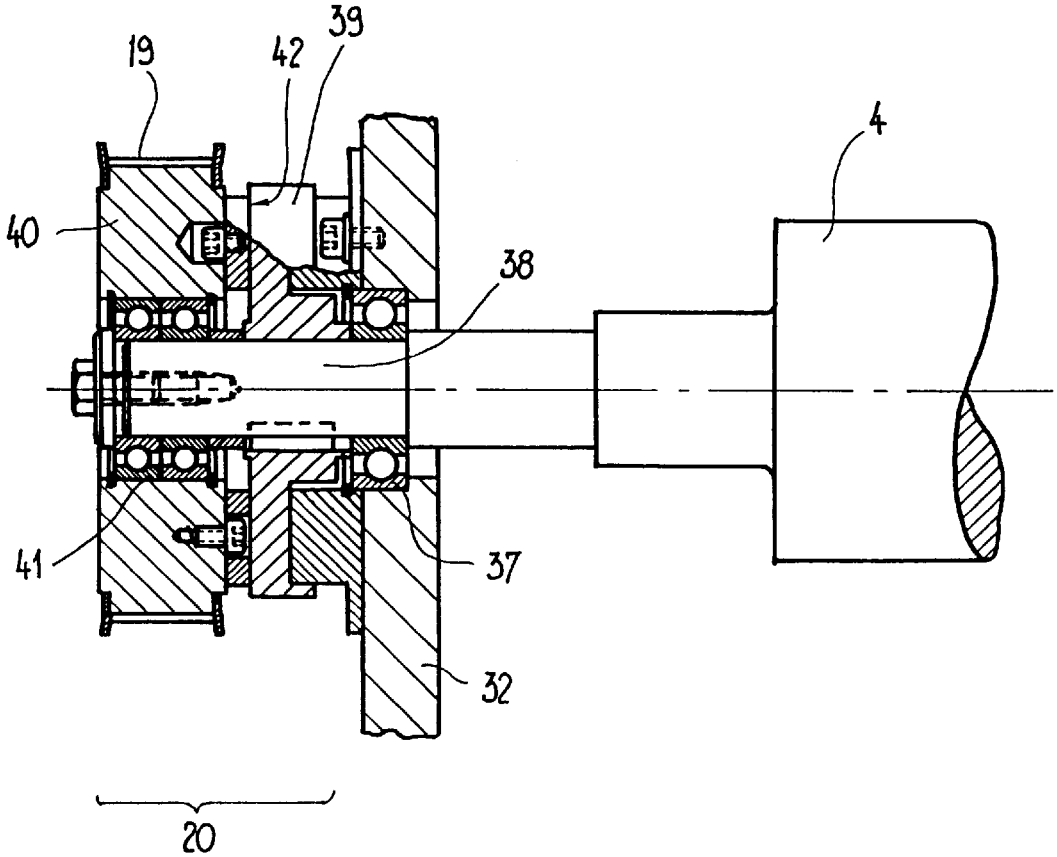
FIG. 4 shows an exemplary embodiment of a clutch.

FIG. 4 shows an exemplary embodiment of a passively acting clutch 20. The winder shaft 4 has a shaft extension 38, which is connected to the housing 32 via a ball bearing 37. The clutch disk 39, forming a component of the clutch 20, is firmly connected to the shaft extension 38. A clutch pulley 40, forming a further component of the clutch 20, is rotatably connected to the shaft extension 38 via a ball bearing 41. The toothed belt 19 acts on the periphery of the clutch pulley 40. The clutch pulley 40 has a friction lining 42 which, in the event of slip, has a rotational speed that differs from the clutch disk 39, and transmits a torque to the clutch disk 39. The clutch 20 may also comprise further, active means (not illustrated), such as an electromagnetic or a pneumatically acting means, in order to influence the contact force between the clutch disk 39 and the clutch pulley 40 in a controlled manner.

In all the exemplary embodiments illustrated, the reel 3 is illustrated as rotating to the right in relation to the feed direction Z. The web 2 could of course also be fed running in such a way that the web 2 is wound up by a reel 3 rotating to the left.

FIGS. 5*a* and 5*b* show an exemplary embodiment of a self-locking mechanism 18 configured as a worm-drive mechanism. The mechanism 18 comprises a housing 18*a*, on which two shafts 18*c*, 18*f* are mounted by means of ball bearings 18*b*. Fastened to the first shaft 18*c* is a sleeve 18*d* having a ring gear 18*e*, which engages in a worm 18*g* on the second shaft 18*f*. If this self-locking mechanism 18 is used in the exemplary embodiment of FIG. 3, the motor 17 drives the second shaft 18*f*, whereas the clutch 20 is connected to the first shaft 18*c*. A large part of the energy transmitted from the clutch 20 to the self-locking mechanism 18 is converted into heat via the worm 18*g* and the ring gear 18*e*, so that a motor 17 of relatively low power is sufficient to drive the second shaft 18*f* in such a way that a braking action is produced on the web tension roll 12.

What is claimed is:

1. A winding apparatus for a web of material, comprising:

a reel for winding up a web of material;

a reel drive apparatus for driving the reel and conveying the web of material in a feed direction Z and winding it onto the reel;

a web tension roll arranged upstream of the reel for producing a tensile force on the web acting counter to the feed direction Z;

a drive apparatus coupled to the web tension roll, said drive apparatus comprising:

a drive including a controllable, variable speed motor;

a self-locking gear mechanism connected to the drive; and a clutch arranged between the self-locking gear mechanism and the web tension roll, said clutch permitting slip to be produced between the drive and the web tension roll.

2. The winding apparatus as claimed in claim 1, further comprising:

a control device with sensors for controlling the reel drive apparatus and the drive apparatus.

3. The winding apparatus as claimed in claim 1, wherein the self-locking gear mechanism is configured as a worm-drive mechanism.

4. The winding apparatus as claimed in claim 1, wherein the clutch is a friction-lining clutch, a maximum transmissible torque of the clutch is controlled.

5. The winding apparatus as claimed in claim 1, further comprising:

deflection rolls arranged in relation to the web tension roll such that the web of material is in contact with the web tension roll over part of the circumference of the web tension roll.

6. The winding apparatus as claimed in claim 1, wherein the reel drive apparatus has a driven winder shaft that is arranged at the center of the reel.

7. A method of winding a web of material onto a reel, comprising the steps of:

driving the reel for conveying a web of material in a feed direction Z;

producing a tensile force on the web of material acting counter to the feed direction Z by means of a web tension roll which is arranged up-stream of the reel;

providing a drive apparatus for driving the web tension roll comprising a controllable, variable-speed motor driving a self-locking gear mechanism which drives the web tension roll via a clutch;

operating the clutch with slip; and controlling the drive apparatus so that at least some of the braking energy extracted from the web tension roll is dissipated via the self-locking gear mechanism.

8. The method as claimed in claim 7, wherein at least a speed vZ of the web and the rotational speed of the reel are measured, and wherein, in order to control the tension in the web, and at least one of a speed of a motor of the drive apparatus and a slip of the clutch is varied.

9. The method as claimed in claim 7, wherein the slip is kept within a range of 0 to 10%.

10. The method as claimed in claim 7, wherein a speed of the web tension roll is varied between a maximum speed and a standstill, and wherein, in a higher speed range with respect to the web tension roll, a motor of the drive apparatus is operated in the same direction, and wherein, in a lower speed range, the motor is operated in the opposite direction, in order to maintain a predefined slip value.

11. The method as claimed in claim 7, wherein a diameter of the reel is calculated from a web speed vZ and a reel rotational speed D, and wherein, as the diameter increases, a decreasing web tension is produced.

12. The method according to claim 9, wherein the slip is preferably kept in a range of 0 to 5%.

* * * * *